US005794810A

United States Patent [19]

Hensley

[11] Patent Number: 5,794,810

[45] Date of Patent: Aug. 18, 1998

[54] SCUTTLE FOR POURING PELLETIZED WOOD FUEL

[76] Inventor: Carroll G. Hensley, 3769 Highway 11 E., Limestone, Tenn. 37681

[21] Appl. No.: 804,818

[22] Filed: Feb. 24, 1997

[51] Int. Cl.[6] ..... B65D 21/02

[52] U.S. Cl. ..... 220/408; 220/23.86; 220/501; 220/525; 220/445; 206/514

[58] Field of Search ..... 220/2, 485, 491, 220/23.83, 23.86, 501, 505, 524, 525, 526, 447, 445, 408, 413; 206/514

[56] References Cited

U.S. PATENT DOCUMENTS

| | | | |
|---|---|---|---|
| 11,898 | 11/1854 | Martin . | |
| 26,188 | 11/1859 | Huston . | |
| 35,436 | 6/1862 | Coombs . | |
| 154,817 | 9/1874 | Wright | 220/2 |
| 206,502 | 7/1878 | Tenney . | |
| 262,526 | 8/1882 | Wilson et al. | 220/2 |
| 847,225 | 3/1907 | Barnard | 220/525 |
| 1,831,527 | 11/1931 | Dovidaites | 220/408 |
| 3,129,714 | 4/1964 | Schaefer | 220/408 |
| 5,363,745 | 11/1994 | Lin | 220/408 |

FOREIGN PATENT DOCUMENTS

| | | | |
|---|---|---|---|
| 485 666 | 11/1929 | Germany | 220/2 |

*Primary Examiner*—Stephen J. Castellano

[57] ABSTRACT

A scuttle device for pouring frangible, extruded wood pellets through a slot-like fill port of a hopper of a pellet-burning stove, the device having a wall formed to provide a pellet containment cavity, and having a top cap formed with an opening for filling and emptying the cavity, wherein a fine mesh sieve is supported in the cavity and is spaced from substantially the entire inner surface of the wall to provide a collection space for receiving and retaining pellet fines, and wherein a top rim of the sieve lies closely adjacent the underside of the top cap for preventing spill-over of pellets into the collection space during pouring out of the pellets.

15 Claims, 2 Drawing Sheets

SCUTTLE FOR POURING PELLETIZED WOOD FUEL

BACKGROUND OF THE INVENTION

1. Field Of The Invention

This invention concerns a uniquely shaped and constructed scuttle particularly adapted for containing and pouring pellets of wood material through a fairly narrow loading port of a hopper situated within the shell of a wood pellet burning stove. Such stoves which typically are placed within existing fireplace openings are described in U.S. Pat. Nos.: 4,787,322; 4,945,837; 4,947,769; 5,137,010; 5,295,474; 5,383,446; and 5,488,943, the disclosures of which are hereby incorporated herein by reference in their entirety.

The pellets or other fuel pieces are of compacted and extruded sawdust or small wood shavings and are becoming extensively used as a substitute for coal or firewood. The ends, in particular, of such pellets are frangible and during packaging, transportation, and loading into the stove break off and generate fines, i.e., dust and very small particles. These fines approach the paricle size of flour and will not burn properly in the stove, but rather can char and agglomerate. In addition to creating a mess when pouring the pellets from a conventional scuttle hod device, an accumulation of such fines on the pellets and on the combustion grating as chared agglomerations seriously retards their combustibility of the pellets.

2. Prior Art

Heretofore, various structures and configurations have been proposed for coal scuttles or hods whereby coal dust or ashes could be separated from the coal by falling through a sieve typically positioned above the bottom of the hod. Upon applying a sifting motion to the loaded hod, the fines fall through the sieve into a receptacle which can then be emptied periodically. Such structures are shown in U.S. Pat. Nos.: 11,898; 662,269; 298,180; 134,081; 35,436; and 206,502.

These prior devices no doubt serve a useful purpose with coal pieces which can be jostled around quite vigorously during the sifting operation as well as when being poured from the hod, without further being reduced to fines. Such is not the case, however, with the present extruded pelletized wood fuels. These pellets are small, e.g., 7/32 in. in diameter and about ½ in. in length, and are quite frangible compared to coal chunks. Also, they must be poured through a hopper loading port of, e.g., a 2 in.×18 in. slot to which access is limited by its typical positioning at the back of the pellet stove top and adjacent a wall such as at the front of an existing fireplace. Such pouring often requires jostling of the pellets with consequent further generation of fines.

OBJECTS OF THE INVENTION

Objects of the present invention therefore, are: to provide a scuttle type device which is capable of removing substantially all of the fines from pelletized wood fuels without the need for special precautions during the pouring operation for hopper loading, which operation typically further produces fines; to provide such a device which is configured so that easy pouring of the pellets through a loading port of limited size and access is achieved; to provide such a device which can be completely emptied through said loading port and into a hopper without causing a mess on and around the stove; and to provide such a device which is self-contained and yet easy to empty of captured pellet fines.

SUMMARY OF THE INVENTION

The above and further objects hereinafter appearing have been attained in accordance with the present invention through the discovery of scuttle structure which, in its broad embodiment, is defined as:

a scuttle device for containing and pouring frangible fuel pellets of compacted extruded wood material, said device comprising first wall means having a first bottom section adapted to rest on a floor or other base and further having interconnected first side, back and front sections extending upwardly from said bottom section to form a pellet scuttle device similar to the general exterior configuration of a coal hod, said scuttle device having a pellet containment cavity means formed around a vertical axis and having top means provided by or positioned on upper portions of said first wall sections and formed to provide an access opening to said cavity means, a front portion of said top means being formed to provide a pouring lip means, shoulder means on said top means extending radially inwardly in a plane substantially normal to said axis and substantially extending around the periphery of said access opening, the underside of said shoulder means providing a substantially continuous stop surface means, sieve means formed by second wall means and having interconnected second bottom, side, back and front sections of the general configuration of said first sections and having length, width and height dimensions less than the dimensions said first sections, support means in said cavity means and contacting said first and second wall means and maintaining substantially the entire outer surface of said sieve means at a distance from said first wall means to provide a space means between said first and second wall means for receiving and retaining pellet fines, and wherein rim means is provided on the top periphery of said sieve means and adapted to lie closely adjacent said stop surface means for preventing spill-over of pellets into said space means during the pellet pouring operation.

In certain preferred embodiments:

(a)a rear portion of the shoulder means adjacent the top portion of said first back section is spaced from said first back section to provide a fines emptying port at the top back area of the scuttle device;

(b)the top front portion of the sieve means extends substantially all the way to the pouring lip means, thereby functioning to rid the hopper charge also of fines generated within the scuttle device during the pouring operation; and (c)said top means lies generally in a generally lateral first plane, and said front section of said first wall means lies generally in a generally vertical second plane, wherein said first and second planes are angularly oriented with respect to each other at an angle of from about 30 degrees to about 70 degrees whereby the scuttle device can be completely emptied without interference from fireplace or other wall structures located adjacent the hopper loading port of a pellet burning stove.

BRIEF DESCRIPTION OF THE DRAWINGS

The invention will be further understood from the following drawings which are not uniformly scaled, of preferred embodiments of the invention, and the description thereof, wherein.

DETAILED DESCRIPTION

Figure 3:
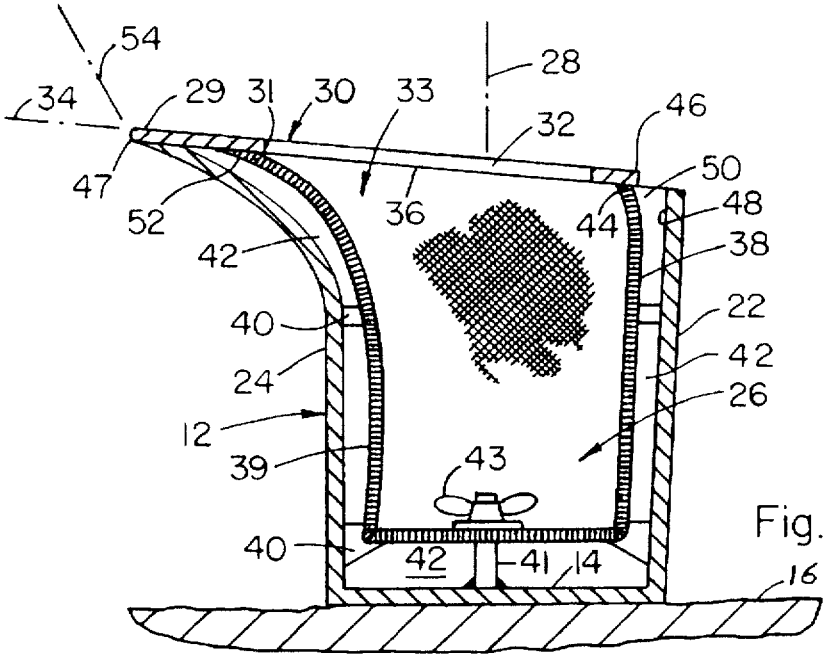
FIG. 3 is a cross-sectional view taken along the line 3—3 of FIG. 2 in the direction of the arrows.

Referring to the drawings and with particular reference to the claims hereof, the present scuttle device 10 comprises first wall means generally designated 12 having a first bottom section 14 adapted to rest on a floor 16 or other base and having interconnected first side 18, 20, back 22 and front 24 sections extending upwardly therefrom to form the scuttle device substantially in the general exterior configuration of a coal hod or scuttle, said device having a pellet containment cavity 26 formed around a vertical axis 28 and further having a top means generally designated 30 provided on the upper portions 29 of said wall sections, the front portion of said top means being formed at its rearward edge to provide pouring lip means 31, peripheral shoulder means 32 on said top means and extending radially inwardly in a first plane 34 oriented substantially normal to said axis and forming an access opening 33 to said cavity means, stop surface means 36 provided by the underside of said shoulder means 32, sieve means or basket 38 provided by meshed second wall means generally designated 39 having the general configuration of said first wall means 12 and having length, width and height dimensions less than the dimensions of said first wall means 12, support means 40 in said cavity means and contacting said first wall means 12 and said sieve means 38 and maintaining substantially the entire outer surface of said sieve means at a distance from said first wall means to provide a fines collection space means 42 for receiving and retaining pellet fines, and wherein said second wall means is formed to provide top rim means 44 on said sieve means adapted to lie closely adjacent said stop surface means 36 for preventing spill-over of pellets into said space means during the pellet pouring operation.

Preferably a rear portion 46 of shoulder means 32 is spaced from the top portion 48 of back wall section 22 to provide a fines emptying port 50 at the top back area of the scuttle device. In this regard, and in a further preferred embodiment, top 30 comprises a removable cap means 60 which allows the sieve 38 to be removed and cleaned. Portions of cap 60 which are equivalent to top means 30 are numbered the same. Cap 60 is formed to provide access opening 33 and the emptying port 50, and further provides the stop surface 36 and the pouring lip 31. Cap 60 is provided further with a downwardly depending skirt 62 which is dimensioned with respect to the top periphery 64 of the first wall means 12 and which extends substantially continuously all the way therearound such that the cap tightly and frictionally, but removably, engages said periphery 64 when the cap 60 is forced thereover.

The top rim 44 of the sieve in a further preferred embodiment is permanently affixed to the shoulder 32 at the stop surface means 36 such that only a single unit of cap and sieve need to be handled for cleaning or the like, and whereby the supports 40 can comprise the aforesaid connection of top rim 44 to shoulder 32 if the sieve is comprised of sufficiently sturdy mesh steel to retain its shape and maintain the integrity of space means 42.

The sieve 38 is preferably stainless steel mesh of from about 1/64 inches to about 1/16 inches mesh size, but smaller or larger mesh openings may also be used. Preferably, the top front portion 52 of the sieve extends substantially all the way to the pouring lip 31, thereby assisting in ridding the hopper charge also of any fines generated within the scuttle device during the pouring operation.

The space 42 does not have to be uniform, but the major portion thereof should be about ¼ in. to about 1 in. in width for best results. The sieve may be held securely in place by means of a threaded stud 41 affixed to bottom section 14 and passing through the bottom of the sieve wall and clamping the sieve bottom by way of wing nut 43, against the supports 40.

Figure 8:
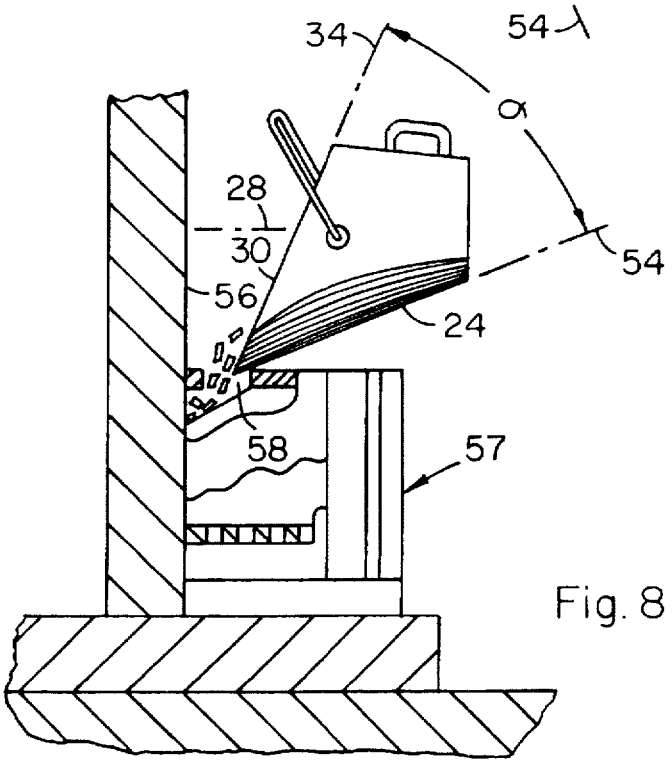
FIG. 8 is a side elevational view of a pellet burning stove of the general type disclosed in the aforementioned patents on page one hereof with portions broken away for clarity and showing a planar front section embodiment of the present scuttle device in a pouring position.

In another important embodiment as most clearly shown in FIG. 8, the top 30, including pouring lip 31, lie in said first plane 34, and the front section 24 lies generally in a second plane 54, wherein said first and second planes are angularly oriented to each other at an angle "a" of from about 30 degrees to about 70 degrees whereby the scuttle device can be completely emptied, e.g., its axis 28 tilted at an angle of 90 degrees or more from the vertical without interference from wall structures such as 56 located adjacent the hopper loading port or slot 58 of a stove 57.

It is noted that the tiny size of the pellets vs. that of coal chunks makes the use of coal hods for pouring the pellets very difficult in that the pellets can spill over the saddle-shaped sides of the hod. These saddles are necessary for conventional coal hods or scuttles for allowing the entire pouring lip of the hod or scuttle to be actually inserted down through the combustion chamber opening in the top of a coal burning stove.

Figure 2:
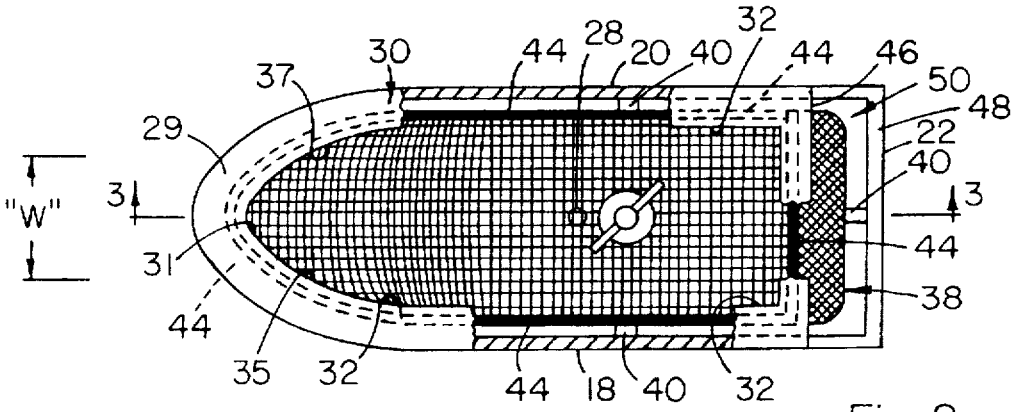
FIG. 2 is a top down view of the scuttle device of FIG. 1 taken in the direction of line 2 in FIG. 1.
Figure 1:
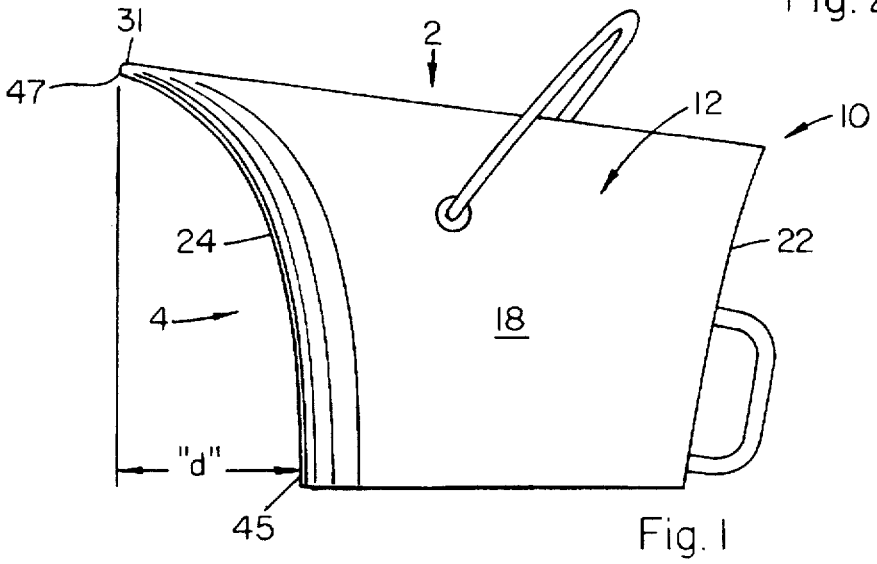
FIG. 1 is a side view of a pellet scuttle device configuration to which the present invention is applicable.
Figure 4:
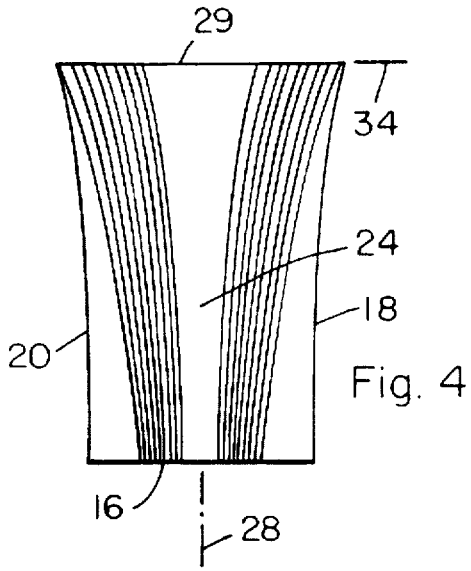
FIG. 4 is a front view of the scuttle device of FIGS. 1–3 taken in the direction of arrow 4 in FIG. 1.
Figure 5:
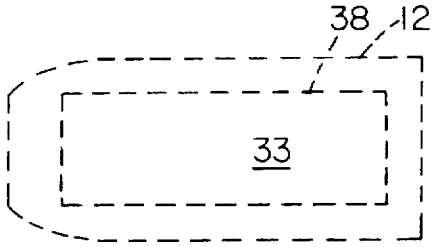
FIG. 5 is a top down view in outline of a generally rectangular variation in first wall and sieve second wall configuration of the scuttle device.
Figure 7:
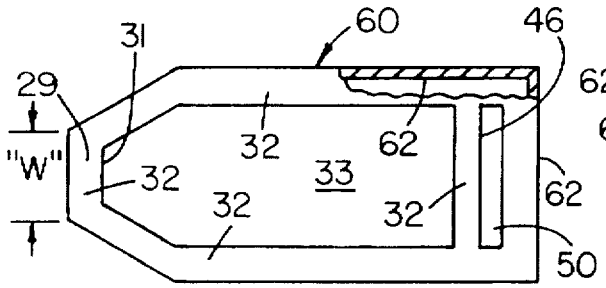
FIG. 7 is a top view of the cap means of FIG. 6.
Figure 6:
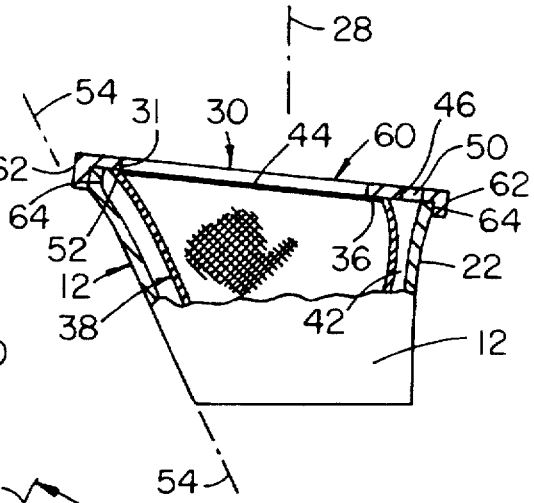
FIG. 6 is a partially cross-sectional view of a scuttle device similar to that of FIG. 1–3 but showing the provision of a removable cap means through which the top access opening and the emptying port are formed, and which further provides the stop surface means and the pouring lip means.

With respect to the present lip means 31, regardless of the width between the inner edge areas 35 and 37 of the shoulder means 32, the width "w" of the pouring lip means 31 is preferably made a little less than the length of the loading port slot 58. Referring to FIGS. 1–3, this width of 31 is approximately ½ the distance "d" between the bottom front edge 45 of the front section 24 and the top front edge 47 of the top means 30.

The present scuttle device may have any desired lateral cross-sectional configuration including rectangular, oval, or as shown in any of the aforesaid prior coal hod patents on page two hereof in the Prior Art section. Likewise, the dimensions of the scuttle can be widely varied and typical dimensions are, e.g., 16 in. high and having a top generally of about 10 in. in width and 15 in. in length, with a base of about 9 in. in width and a length of about 10 in..

The invention has been described in detail with particular reference to preferred embodiments thereof, but it will be understood that variations and modifications will be effected within the spirit and scope of the invention.

I claim:

1. A scuttle device for pouring frangible fuel pellets of compacted, formed wood material into a stove hopper through a slot-like entry port, said device comprising first wall means having a first bottom wall section adapted to rest on a building floor or other base and having interconnected first opposing side wall sections and first opposing front and back wall sections extending upwardly from said bottom wall section to form the scuttle device substantially in the general exterior configuration of a coal scuttle or hod having a cavity means formed by said first wall means generally around a vertical axis, generally planar top means provided on the upper portions of said wall sections, said top means having a front portion and a rear portion lying generally coincident with said upper portions of said front and back wall sections respectively, and further having an outer periphery, shoulder means extending generally radially inwardly from said outer periphery in a first plane oriented substantially normal to said axis and radially inwardly terminating to form an access opening to said cavity means, a radially inner edge of said front portion of said top means being formed to provide pouring lip means, stop surface means provided by the underside of said shoulder means adjacent to said access opening, sieve means positioned in said cavity means and provided by second wall means of mesh material having the general configuration of said first wall means and having a second bottom wall section, second opposing side wall sections and second opposing front and back wall sections which have length, width and height dimensions less than the dimensions of the corresponding sections of said first wall means, support means contacting said sieve means and maintaining substantially the entire outer surface of said sieve means at a distance from the inner surface of said first wall means to provide a collection space for receiving and retaining fuel pellet fines, wherein said second wall means is formed to provide upper rim means on said sieve means, said rim means being adapted to lie closely adjacent said stop surface means for allowing passage of said fines into said collection space while preventing spill-over of pellets into said collection space and spill-out of pellet fines from said collection space during the pellet pouring operation, and wherein said rear portion of said top means is formed to provide a fines emptying port at the top back area of the scuttle device.

2. The device of claim 1 wherein a top front portion of said sieve means extends substantially all the way to the underside of said pouring lip means, thereby functioning to sieve the hopper charge also of fines generated within the scuttle device during the pouring operation.

3. The scuttle device of claim 1 wherein said pouring lip means and the other portions of said top means lie generally in a first plane, and said front wall section of said first wall means lies in a second plane, and wherein said first and second planes are angularly oriented with respect to each other at an angle of from about 30 degrees to about 70 degrees whereby the scuttle device can be readily tipped at a 90 degree angle or more to its axis for completely emptying the scuttle device into a stove hopper loading port without interference from building structures located adjacent the rear of said loading port.

4. The scuttle device of claim 1 wherein said top means comprises a removable cap means for allowing said sieve means to be removed from said cavity means and cleaned.

5. The scuttle device of claim 4 wherein said cap means is formed to provide (a)said access opening, (b)said emptying port, (c)said stop surface means, and (d)said pouring lip means.

6. The scuttle device of claim 5 wherein said cap means is so provided with a downwardly depending skirt means which is dimensioned with respect to the top periphery of said first wall means and which extends substantially continuously all the way therearound such that said cap means tightly and frictionally, but removably, engages said periphery when said cap means is forced thereover.

7. The scuttle device of claim 1 wherein said upper rim means of said sieve means is permanently affixed to said stop surface means such that only a single unit of said cap means and sieve means need to be handled for cleaning.

8. The device of claim 1 wherein said rear portion of said top means is laterally, inwardly spaced from said first back wall section to provide said emptying port.

9. The device of claim 1 wherein said top means is formed to provide an emptying port at its rear portion, said port communicating with a rear area of said collection space.

10. The scuttle device of claim 1 wherein said upper rim means of said sieve means is permanently affixed to said stop surface means such that only a single unit of said top means and sieve means needs to be handled for cleaning or assembly.

11. The scuttle device of claim 10 wherein said top means is removably mounted on said upper portions of said first wall sections.

12. The scuttle device of claim 1 wherein said top means is removably mounted on said upper portions of said first wall sections.

13. The scuttle device of claim 12 wherein said outer periphery of said top means is provided with a downwardly depending skirt means which is dimensioned to fit snugly but removably over said upper portions of said first wall sections.

14. A scuttle device for pouring frangible fuel pieces into a stove hopper through a slot-like entry port, said device comprising an integral first wall having a first bottom section adapted to rest on a building floor or other base and having opposing first side sections and opposing first front and back sections extending upwardly from said first bottom section to form the scuttle device substantially in the general exterior configuration of a coal scuttle having an open top cavity formed by said first wall substantially around a vertical axis and having a top edge, a generally planar pouring cap member provided on said top edge and extending generally radially inwardly from said edge in a first plane oriented substantially normal to said axis and radially inwardly terminating to form an access opening in said cap member to said cavity, said cap member having a front portion and a rear portion substantially coincident with said first front and back sections respectively of said first wall, a radially inner edge of said front portion being formed to provide a pouring lip, a stop surface provided by the underside of said cap member adjacent to said access opening and extending around said opening, an open top sieve basket provided within said cavity and being formed by a second wall of finely perforated material, said sieve basket having length, width and height dimensions less than the dimensions of said first wall, support structure for said sieve basket and maintaining substantially the entire outer surface of said second wall at a distance from said first wall to provide a substantially continuous collection space between said sieve basket and said first wall for receiving and retaining fuel fines, and wherein said second wall is formed to provide upper rim means on said sieve basket, said rim means being adapted to lie closely adjacent said stop surface for allowing passage of said fines into said collection space while preventing spill-over of fuel pieces into said collection space and spill-out of fuel piece fines from said collection space during the fuel piece pouring operation, and wherein a rear portion of said cap member is formed to and wherein said emptying port communicates directly with said collection space but not directly with the interior of said sieve basket.

15. The device of claim 14 wherein the top front portion of said sieve basket extends substantially all the way to the radially innermost underside edge of said pouring lip, thereby functioning to sieve the hopper charge also of fines generated within the scuttle device during the pouring operation and to provide a substantially uninterrupted flow path for fuel pieces being poured from the scuttle device.

* * * * *